United States Patent [19]

McAllister

[11] Patent Number: 5,057,004

[45] Date of Patent: Oct. 15, 1991

[54] SPRAY BURN FLOATING COMBUSTIBLE MATERIAL BURNER

[76] Inventor: Ian R. McAllister, 3922 W. 11th Avenue, Vancouver, B.C., Canada, V6R 2L2

[21] Appl. No.: 553,973

[22] Filed: Jul. 17, 1990

[51] Int. Cl.[5] ..... F23D 11/00

[52] U.S. Cl. ..... 431/202; 431/5; 431/9; 431/117; 431/8; 210/923

[58] Field of Search ..... 431/9, 5, 8, 117, 202; 210/923-925

[56] References Cited

U.S. PATENT DOCUMENTS

| | | | |
|---|---|---|---|
| 3,602,299 | 8/1971 | Moaic | 431/202 |
| 3,902,843 | 9/1975 | Genini et al. | 431/202 |
| 3,914,093 | 10/1975 | Proctor | 431/202 X |
| 3,920,378 | 11/1975 | Castela et al. | 431/202 |
| 4,308,006 | 12/1981 | Koblanski . | |
| 4,576,569 | 3/1986 | Koblanski . | |
| 4,669,972 | 6/1987 | Koblanski . | |

*Primary Examiner*—Larry Jones

*Attorney, Agent, or Firm*—Dean A. Craine

[57] ABSTRACT

A spray burn floating combustible material burner apparatus is disclosed herein used to remove a floating layer of combustible material, such as oil, from a body of water. The apparatus includes a support frame attached to a buoyancy system, an air nozzle, an air nozzle adjustment means, drop-catching means, a deflection plate, a stabilization plate, and an ignition source. The air nozzle is attached to the air nozzle adjustment means, which adjusts the vertical position of the air nozzle with respect to the surface of the floating layer, and to an adjustible supply of compressed air which, during operation, vertically lifts and atomized the floating layer into droplets in the apparatus' combustion region. The ignition source located in the combustion region destroys the atomized droplets by combustion. The drop-catching means is positioned above the combustible material and prevents any ignited droplets from falling into the surrounding layer of combustible material. A deflection plate is attached to the drop-catching means. During operation, the compressed air from the air nozzle passes through the deflection plates's lower circular opening which induces the air current between the deflection plate and the surface of the floating layer towards the lower circular opening. The induced air current, in turn, induces the floating layer towards the air nozzle so that combustion continues. The stabilization plate, in response to wave action, stabilizes and also induces the flow of the floating layer into the apparatus.

22 Claims, 8 Drawing Sheets

SPRAY BURN FLOATING COMBUSTIBLE MATERIAL BURNER

TECHNICAL FIELD

This invention relates to apparatus used to remove environmental pollutants from relatively large bodies of water. More particularly, this invention relates to apparatus used to remove a floating layer of combustible material, such as oil, from the surface of a large body of water using combustion.

BACKGROUND ART

Heretofore, several methods have been used to remove a floating layer of combustible material, such as oil, from the surface of large bodies of water. One method uses open, in situ burning of the floating layer of combustible material on the water surface. Another method employs a floating burning device that first atomizes the floating combustible layer and then destroys it by combustion. Ideally, such devices should operate efficiently and safely under typical weather conditions with little or no human supervision. Also, such devices should be relatively small and compact for quick and easy deployment in an emergency situation.

U.S. Pat. Nos. 4,308,006 and 4,576,569 both disclose floating oil burning devices that remove a floating oil layer from a large body of water using atomization and combustion. In each device disclosed therein, acoustical energy is used in the atomization process. More particularly, in U.S. Pat. No. 4,308,006, acoustical energy is produced by a sound generating means located at or slightly below the oil layer surface. In U.S. Pat. No. 4,576,569, a resonating chamber is placed above a compressed air source which is submerged below the oil surface. A supply of stream of compressed air is transmitted vertically into a resonating chamber. A depression element located beneath the resonating chamber receives diverging shocks waves produced by the resonating chamber which then acts to shear and atomize the oil layer. The atomized oil droplets are then burned by a combustion means.

The devices disclosed in the above mentioned patents have several drawbacks. First, it has been discovered that using acoustical energy to produce shocks that shear and atomize the oil layer is very inefficient and, at times, ineffective. It has been discovered that a stream of compressed air alone properly located below the surface of the oil layer is as efficient and as effective as the acoustical energy methods used in the above patents. Second, because the devices described in the above patents use relatively large components to create the acoustic energy, the devices themselves difficult to transport and are relatively unstable in certain weather conditions.

A third drawback with the device disclosed in U.S. Pat. No. 4,576,569, is that ignited oil droplets often escape from the combustion plume and fall into the floating oil layer surrounding the device. This causes the surrounding oil layer to ignite and burn in an uncontrollable manner which may actually destroy the device and create large, environmentally undesirable clouds of smoke.

In still fourth drawback of above disclosed devices is the possible interruption of the delivery of the floating oil layer into the device. It is well known that wind and wave action may interfere with the oil layer's movement into the device during operation. When this occurs, atomized oil droplets are no longer produced for combustion which may cause a cessation of combustion. Before combustion can resume, reignition of the combustion means within the device would be required. This would require constant monitoring of the device during the operation.

A floating oil burning device or apparatus which do not have these drawbacks, therefore, would be highly desirable.

DISCLOSURE OF INVENTION

It is a general object of the present invention to provide an efficient floating burner apparatus that can remove and destroy a floating layer of combustible material.

It is an object of the present invention to provide such an apparatus that is both economical and safe to operate and that can also be quickly and easily deployed during a spill emergency.

It is another object of the present invention to provide such an apparatus that, during operation, continuously induces the flow of the layer of combustible material into the apparatus using an induced air flow and normal water motion.

It is a still further object of the present invention to provide such an apparatus that burns the layer of floating combustible material in a safe and controlled manner, that generates little smoke or ash, and that requires little or no human intervention during operation.

The present invention provides an apparatus for removing a floating layer of combustible material, such as oil, (hereinafter called a floating oil layer) from the surface of a body of water. The apparatus comprises a support frame attached to a buoyancy system. The buoyancy system comprises a plurality of float structures attached to the support frame that keep the apparatus afloat, and which keep the support frame submerged below the surface of the body of water. An air nozzle is attached to the apparatus and sends an adjustable supply of compressed air into the combustion region located immediately above the air nozzle and above the surface of the body of water. In the process, the floating oil layer located immediately above the air nozzle is atomized and lifted into the combustion region. A nozzle adjusting means allows the position of air nozzle to be adjusted vertically so that the distance between the air nozzle and the surface of the body of water and oil layer can be adjusted for optimal operation.

It has been discovered that ability of the apparatus to lift and atomize of the oil layer into the combustion region is substantially affected by the pressure of the compressed air and the position of the air nozzle with respect to the surface of the oil layer. By selecting the proper pressure of compressed air and the proper position of the air nozzle, optimal lifting and atomization can occur. During operation, conditions at the site may change therefore requiring adjustments in the pressure of the compressed air and the position of the air nozzle.

A drop-catching means is disposed above the floating oil layer and below the combustion region which acts to prevent ignited oil droplets from falling from the combustion plume into the floating oil layer during operation. The drop catching is conical structure with an upper and lower circular edge. The upper circular edge has a diameter sufficient to cover the support frame. In different embodiments, the drop-catching means is made of either light-weight screen material or solid plate material.

A deflection plate is attached to the drop-catching means near the lower circular edge. The deflection plate has a lower circular opening which allows the stream of compressed air from the air nozzle to be transmitted vertically into the combustion region during operation. The top and bottom surface of the deflection plate are manufactured so that as the air stream passes through the lower circular opening, the air current between the deflection means and the surface of floating layer of combustible material is induced towards the lower circular opening. The induced air current then further induces the flow of the oil layer into the central region of the apparatus.

A stabilization plate is attached to the apparatus to keep it relatively stable in typical or rough water conditions. The stabilization plate is disposed horizontally above the support structure and below the water surface. The stabilization plate comprises a flat circular plate structure having a plurality of centrally located motion valves which open or close in response to water pressure on the plate's top and bottom surfaces. A valve disk located in each motion valve moves vertically to open or close a valve port opening in response to different pressures on the plate surfaces. By using a plurality of motion valves on the stabilization plate, the amount of water on the stabilization plate top surface may be controlled, which acts to increase or decrease the overall mass of the apparatus. By changing the apparent overall mass of the apparatus, the stability of the apparatus can be maintained in rough water conditions. In addition, the motion valves also act to induce the flow of the oil layer into the apparatus using normal water motion.

An ignition source is provided to ignite the atomized oil droplets. The ignition source comprises a gas nozzle, an ignition means, and a combustible fuel source. The gas nozzle and the ignition means is located immediately above the drop-catching means and causes combustion of the oil droplets in the combustion region. A combustible fuel source delivers a combustible fuel, such as propane, to the gas nozzle where it is ignited by the ignition source.

An optional screen stack may be attached near the circular edge of the drop-catching means to prevent chilling of the combustion plume caused by cross-winds.

BRIEF DESCRIPTION OF DRAWINGS

FIG. 9(*b*) is a sectional view similar to FIG. 8 and 9(*a*) illustrating the motion valve in a opened position.

BEST MODE FOR CARRYING OUT THE INVENTION

Figure 1:
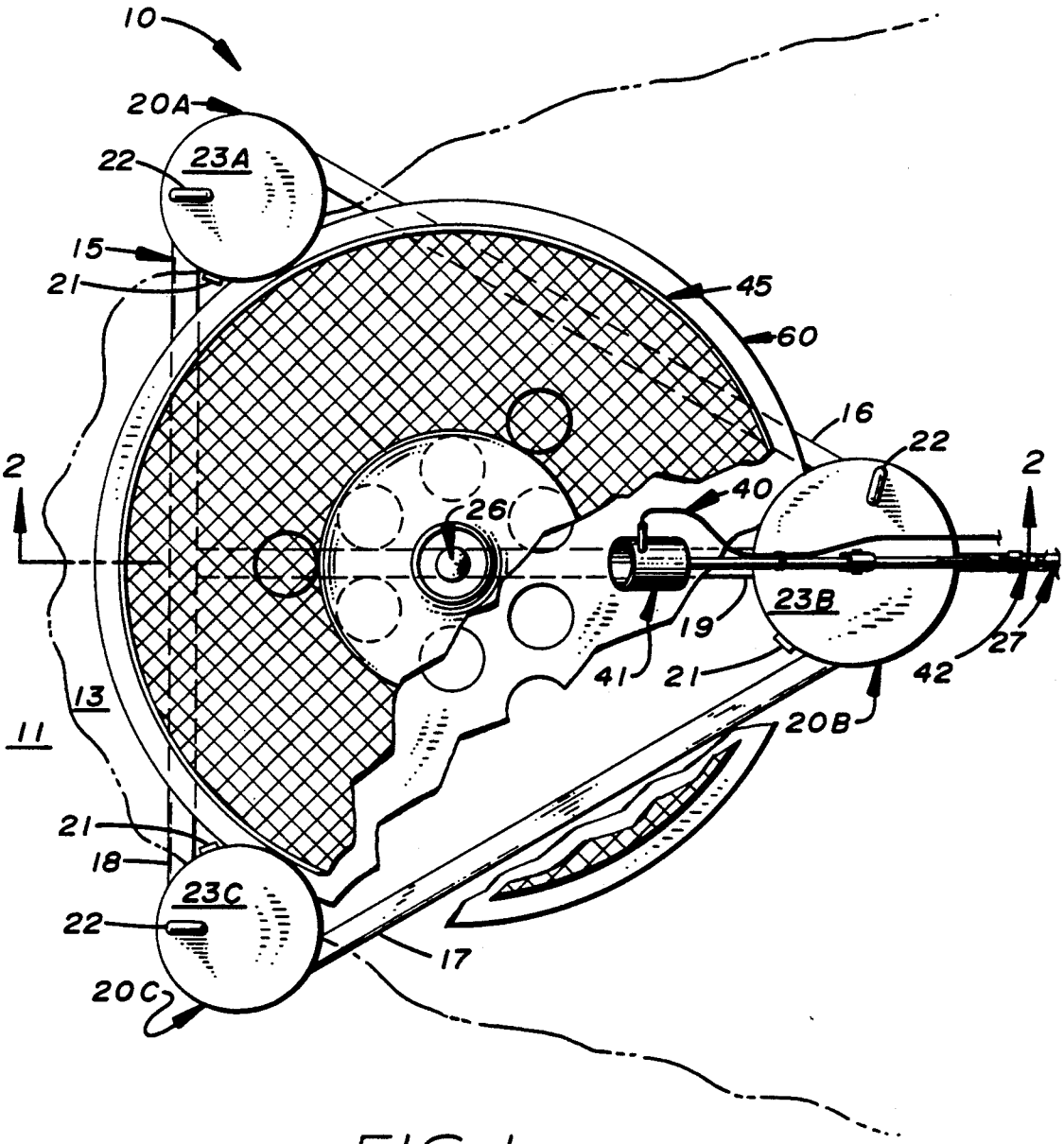
FIG. 1 is a plan view, partially broken away, of an embodiment of the present invention.
Figure 2:
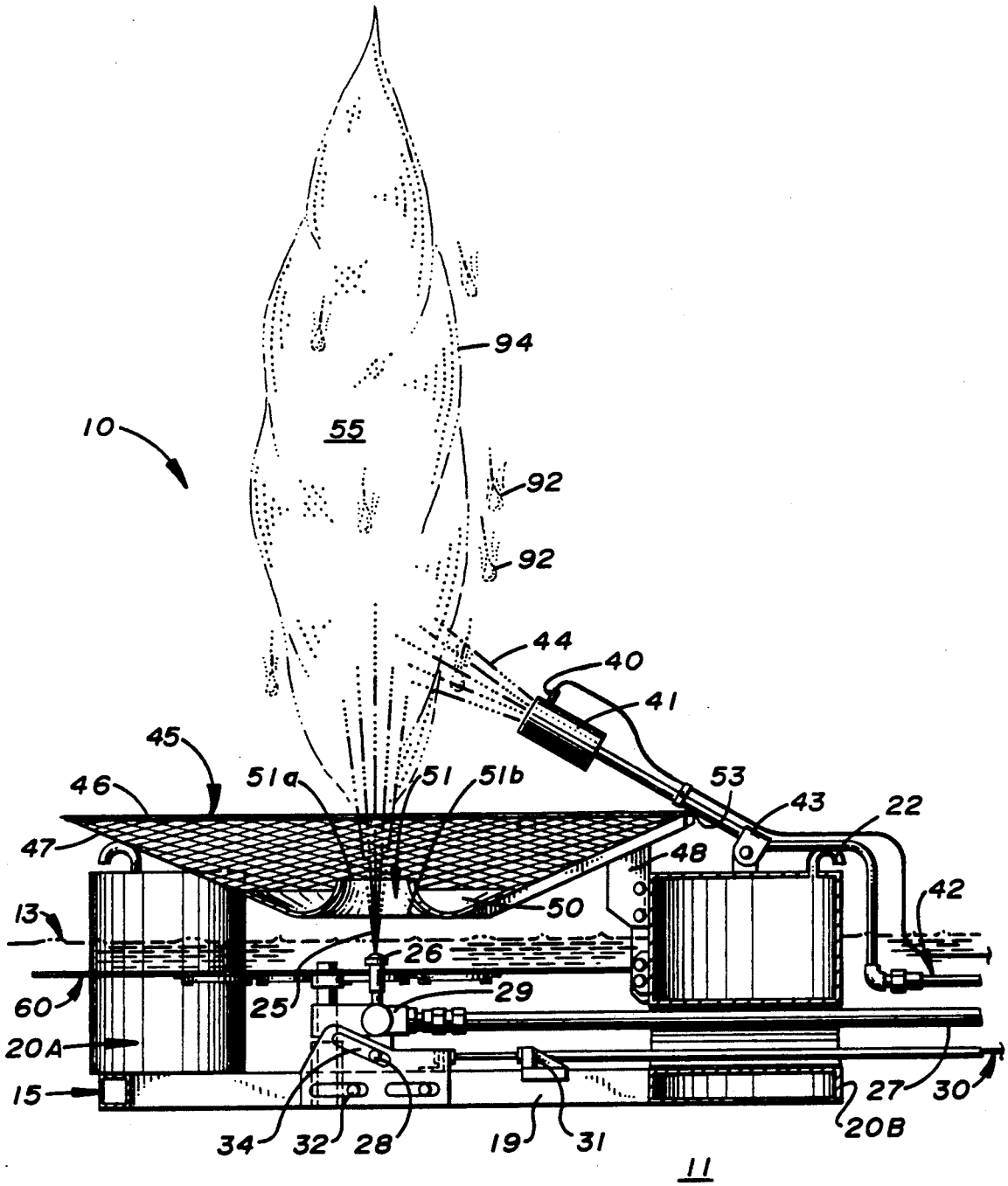
FIG. 2 is a cross-sectional side view of the embodiment illustrated in FIG. 1 in operation.

Shown in FIGS. 1 and 2 is a apparatus, generally referred to by the number 10, used for removing a layer of oil 13 or other floating, combustible materials from the surface of a large body of water 11. The apparatus 10 comprises a rigid support frame 15; a centrally located air nozzle 26 attached to a compressed air source 27; an ignition source including a gas nozzle 41, and an ignition means 40, and a combustible fuel source 42; a drop-catching means 45; and a stabilization plate 60.

In the preferred embodiment, support frame 15 is triangularly-shaped, comprising three rigid leg members 16, 17, and 18 and a central frame member 19. Each leg member 16, 17, and 18, and central frame member 19 are made of square-shaped shaped tubing made of salt water-resistant material, such as stainless steel, each measuring approximately 1½ inches in cross-section. Central frame member 19 extends horizontally from one corner of the support frame 18 to approximately the mid-point of the opposite leg member 15 and is used to support the air nozzle 26 and the various components of the nozzle adjustment means described further below.

Support frame 15 is rigidly attached to a buoyancy means which keeps apparatus 10 afloat in the body of water 11. In the preferred embodiment, the buoyancy means comprises three float structures 20(A),(B),and (C) attached at each corner of support frame 15. Each float structure, 20(A), (B), and (C) is cylindrically-shaped with float structures 20(A) and 20(C) each measuring approximately 8 inches in diameter and 8 inches in height and float structure 20(B) measuring approximately 10 inches in diameter and 8 inches in height. Together, float structures 20(A), (B), and (C) provide approximately 50 pounds of buoyancy force. Each float structure 20(A),(B), and (C) is water-tight with thin walls made of stainless steel with a float expansion vent 22 located on upper surface 23(A), (B), and (C), respectively, and a float drain 21 located on a side surface.

As seen in FIG. 2, each corner of the support frame 15 is attached to a float structure 20(A) or (B) or (C) in a manner such that when apparatus 10 is placed in relatively calm water, support frame 15 is disposed approximately horizontally 4 to 4½ inches beneath the surface of the body of water 11. A vertically adjustable air nozzle 26 is disposed approximately centrally on apparatus 10 above support frame 15. When apparatus 10 is place in the body of water 11, air nozzle 26 is disposed beneath the surface. The longitudinal axis of air nozzle 26 is aligned approximately perpendicular to support frame 15. Air nozzle 26 is attached via an air nozzle bracket 29 to an adjustable compressed air source 27. During operation, an adjustable supply of compressed air 25 is transmitted from the compressed air source 27, through the air nozzle bracket 29, and to air nozzle 26.

Figure 3:
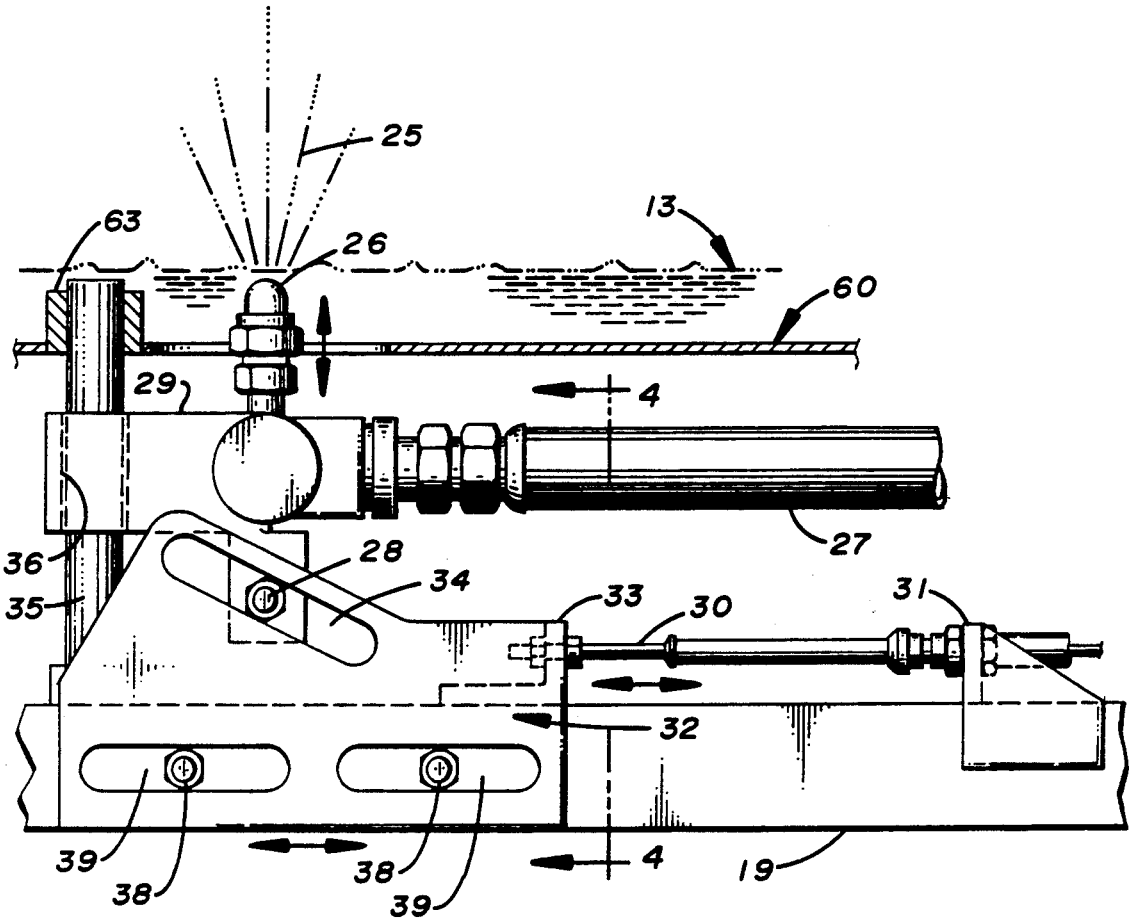
FIG. 3 is a partial, cross-sectional side view illustrating the vertical movement of the adjustable jet stream nozzle.
Figure 4:
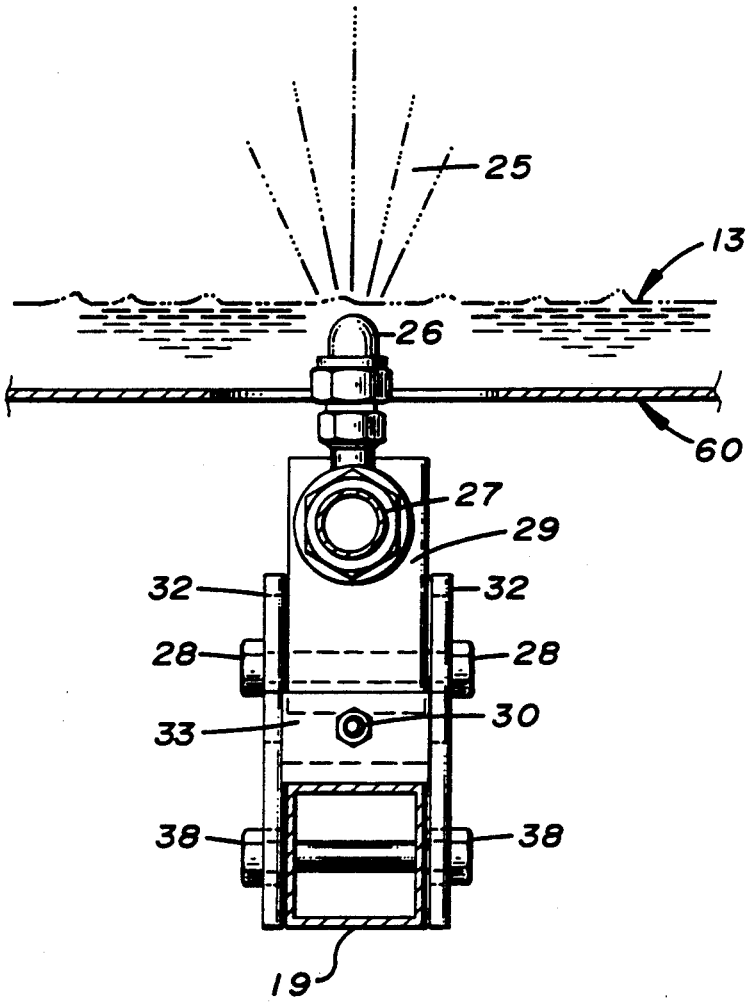
FIG. 4 is a partial, sectional view taken along lines 4—4 in FIG. 3 showing the adjustment plates attached to the air nozzle bracket.

A nozzle adjustment means adjusts the vertical position of air nozzle 26 with respect to the surface of the body of water 11. In the preferred embodiment, shown in greater detail in FIGS. 3 and 4, the nozzle adjustment means comprises a air nozzle bracket 29, two vertically disposed rigid adjustment plates 32, a guide pin 35, and an air nozzle adjustment cable 30. The upper end of the air nozzle bracket is attached to the air nozzle 26. The two adjustment plates 32 are slidably connected to the lower section of air nozzle bracket 29 and are interconnected at one end by a cross-member 33. Each adjustment plate 32 is slidably attached to the air nozzle bracket 29 by a pin opening 34 located on each adjustment plate 32 which engages a pin 28 which extends laterally from each side of the lower section of the air nozzle bracket 29. The longitudinal axis of each pin opening 34 is oriented downwardly, diagonally across each adjustment plate 32 so that as the adjustment plates 32 move horizontally, the air nozzle bracket 29 forcibly moves vertically. The adjustment plates 32 are also slidably fixed to the vertical, outside surfaces of central frame member 19. Two, horizontally oriented, roller pins openings 39 are manufactured on each adjustment plate 32 which engage two roller pins 38 located on each vertical surface of the central frame member 19. Roller pins 38 and roller pins openings 39 enable adjustment plates 32 to move freely along central frame member 19 with little resistance.

As mentioned above, the air nozzle bracket 29 is attached at end to an adjustable compressed air source 27. Near the opposite vertical end of the air nozzle bracket 29 is a bore 36 through which the guide pin 35 extends. Guide pin 35 is disposed vertically between the central frame member 19 and the stabilization plate 60. The lower end of guide pin 35 is rigidly fixed to central frame member 19 while the upper end of guide pin 35 extends through a sleeve opening 63 located on the stabilization plate. Guide pin 35 acts to horizontally and vertically align and prevent horizontal movement of the air nozzle bracket 29. Guide pin 35 also acts slidably to interconnect central frame member 19 and allow the air nozzle bracket 29 to move vertically relative to the central frame member 19 and the stabilization plate 60.

The air nozzle adjustment cable 30 attaches at one end to the cross member 33. During operation, adjustment cable 30 is either pulled or pushed which causes the adjustment plates 32 move horizontally along central member 19. The pins 28 located on air nozzle bracket 29 engage the pin openings 34 to forcibly move vertically the air nozzle bracket 29. In this manner, the location of air nozzle 26 with respect to the surface of oil layer 13 may be adjusted to a suitable position. A cable support means 31 is attached at one end to the central frame member 19 to rigidly secure the outer sheath of the cable 30 thereto. In the preferred embodiment, air nozzle 26, air nozzle bracket 29, adjustment plates 32, cross-member 33, and guide pin 35 are all made of salt water-resistant material, such as stainless steel or aluminum.

As shown in FIG. 2, during operation, a combustion region 55 is located on apparatus 10 above the body of water 11. An ignition source is provided in the combustion region 55 to ignite the atomized oil droplets. The ignition source comprises a gas nozzle 41, an ignition means 40 and a combustible fuel source 42. The gas nozzle 41 extends into combustion region 55 and attaches at one end to a combustible fuel source 42 and delivers a combustible fuel 44, such as propane gas. The combustible fuel 44 ignites the atomized oil droplets that are sent vertically into the combustion region 55 during operation. A gas nozzle support means 43 attaches to one end of the gas nozzle 41 to the top surface of float structure 20(B). An ignition means 40 is disposed adjacent to the outlet end of gas nozzle 41 and used to initially ignite the emitted combustible fuel 44. In the preferred embodiment, ignition means 40 is electrically activated by switches (not shown) located at a safe distance away from apparatus 10. Also, a combustion fuel storage means (not shown) and a compressed air storage means (not shown) are stored and regulated a safe distance from apparatus 10.

Figure 5:
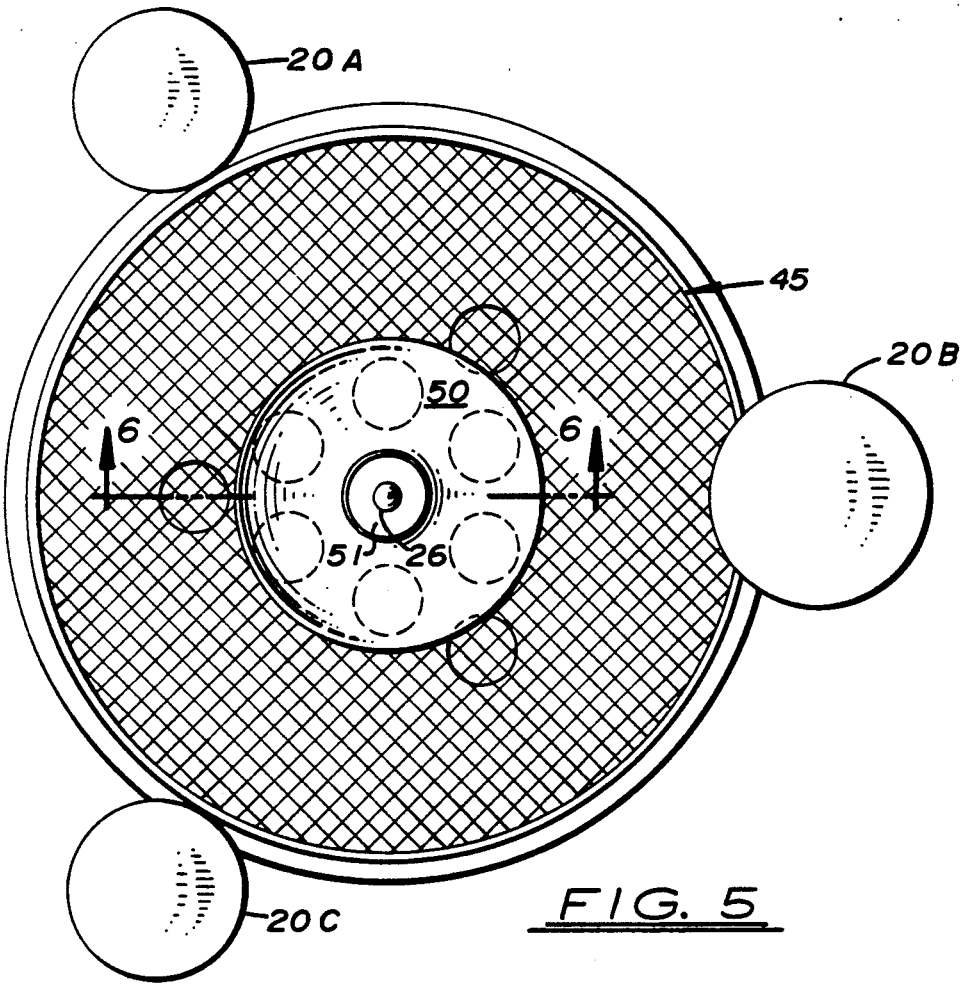
FIG. 5 is a plan view showing the drop-catching means with a deflection plate attached.

As shown in FIGS. 1, 2, and 5, a circular drop-catching means 45, is attached to apparatus 10 between the float structures 20(A), (B) and (C), above the surface of the layer of oil 13, and below combustion region 55. Drop-catching means 45 prevents any ignited oil droplets 92 from falling into and igniting the oil layer 13. Drop-catching means 45 is a conical structure with a large circular upper edge 46 and a lower surface 47. Upper edge 46 has a diameter sufficient to cover the support frame 15. A bracket 48 attaches the lower surface 47 of the drop-catching means 45 to one or more float structures (20B shown). An opening 53 is manufactured on the surface of drop-catching means 45 which enables gas nozzle 41 to extend into combustion region 55. In the preferred embodiment, the drop-catching means 45 is made of light-weight, heat-resistant stainless steal screen material with a screen opening size measuring approximately $\frac{1}{2}$ inches (W)$\times\frac{3}{4}$ inches (H). Alternatively, drop-catching means 45 may be made of heavy solid plate stainless steel (not shown).

Figure 6:
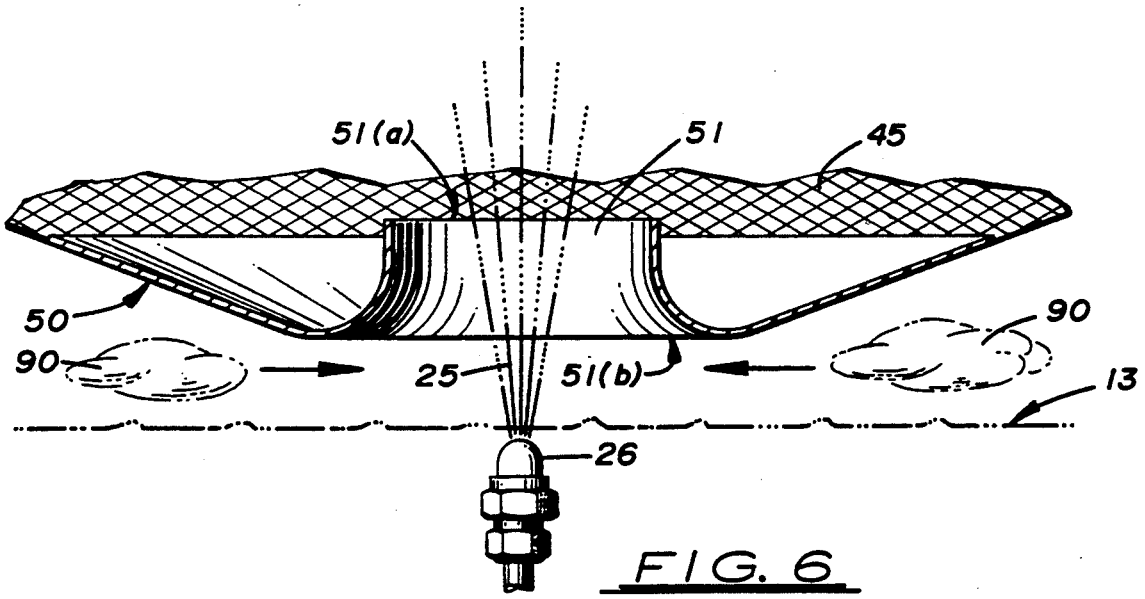
FIG. 6 is a partial sectional view taken along lines 6—6 in FIG. 5 showing the deflection plate attached to the lower surface of the drop-catching means.

As shown in greater detail in FIG. 6, a circular deflection plate 50 is attached to the lower section of drop-catching means 45 to induce the flow of the oil layer 13 into the central area of the apparatus 10. Deflection plate 50 is a conical structure complimentary in shape to the lower section of the drop-catching means 45. Deflection plate 50 is cup-shaped in cross-section with a lower circular opening 51 which allows the adjustable supply of compressed air 25 to pass into the combustion region 55 during operation. The top surface 51(a) of the lower circular opening 51 is round and extends upwardly towards the combustion region 55. The bottom surface 51(b) of the lower circular opening 51 is round thereby producing an injection nozzle effect during operation of apparatus 10 as the stream of compressed air 25 flows through the lower circular opening 51. The injection nozzle effect induces air flow into the lower circular opening 51 by entraining and thereby inducing air currents 90 parallel to the surface of the oil layer 13. The air currents 90, in turn, induces the flow of the oil layer 13 towards the air nozzle 26 and thereby, acts to maintain a continuous supply of oil to the apparatus 10.

As shown in FIGS. 1 and 2, a stabilization plate 60, is disposed above support frame 15 and below defection plate 50. When apparatus 10 is placed in the body of water 11, the stabilization plate 60 is disposed along the surface thereof. Stabilization plate 60 is used to stabilize apparatus 10 in the body of water 11. Stabilization plate 60 is circular and relatively flat with a top surface 61 and bottom surface (not shown) and is made of strong, light-weight material, such as aluminum. Stabilizing plate 60 is approximately $\frac{1}{8}$ inch thick with an outer diameter approximately equal to or slightly less than the inside dimension of support frame 15.

Figure 7:
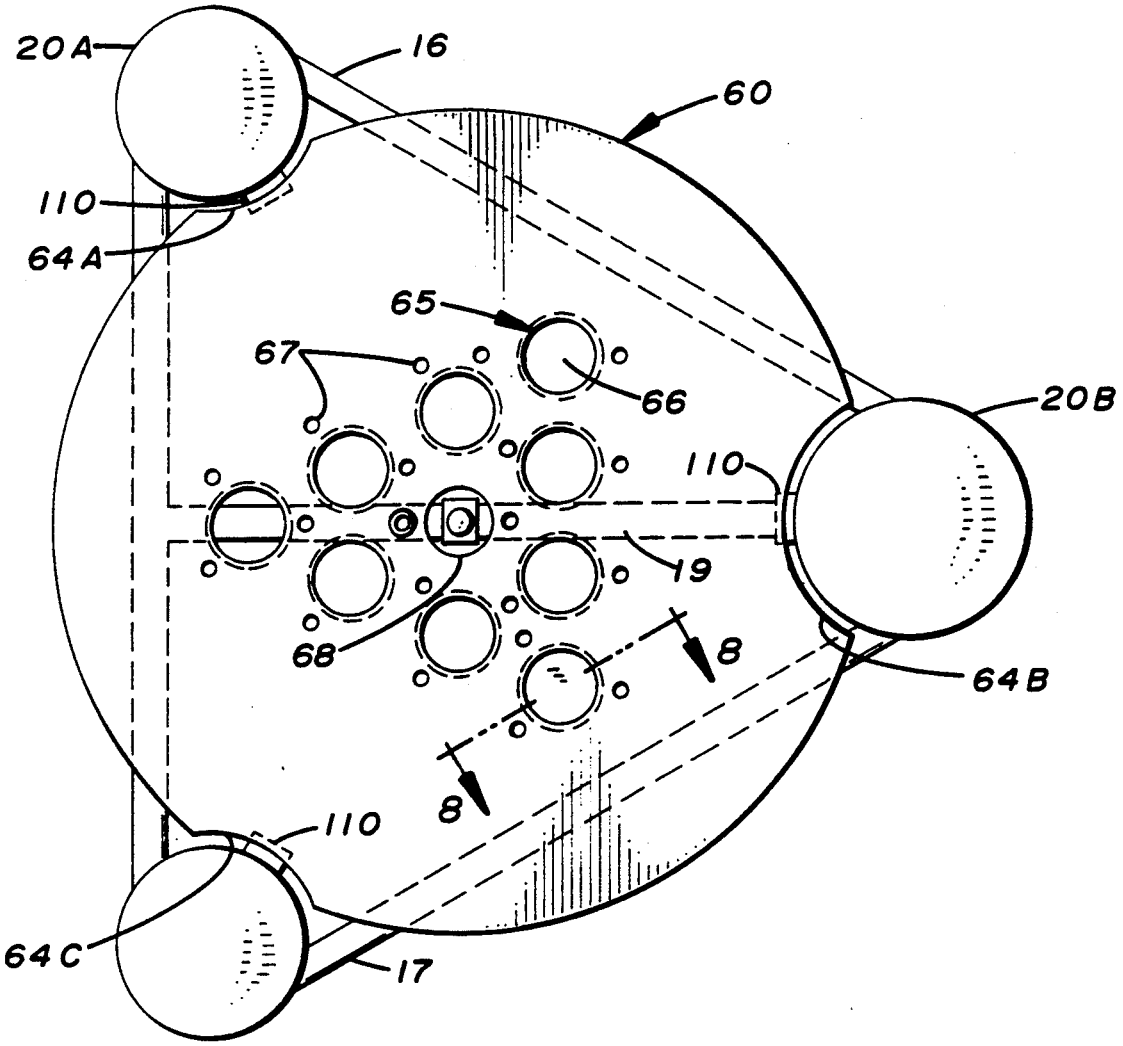
FIG. 7 is a partial plan view of the embodiment illustrated in FIG. 1 with the upper components removed showing the stabilization plate attached to the float structures and support frame.

As shown in FIG. 7, stabilization plate 60 has three half-circular cutouts 64(A),(B),(C), which enable it to fit closely around float structures 20(A),(B), and (C), respectively. Float cutouts 64(A),(B), and(C), are approximately 120° apart with cutouts 64(A) and (B) measuring approximately 8.3 inches in diameter and cutout 64(C) measuring approximately 10.3 inches in diameter. During manufacture, stabilization plate 60 is rigidly attached to the float structures 20 (A), (B) and (C) with brackets 110 so that the stabilization plate 60, the float structures 20(A), (B), and (C), and the support frame 15 operate as a single unit in the body of water 11. Located centrally in a triangular pattern on the surface of stabilization plate 60 are nine port openings 66 which each make up part of a motion valve 65. A central jet opening 68 is manufactured centrally on the stabilization plate 60 through which the stream of compressed air 25 may extend during operation. Three clip openings 67 are manufactured at approximately equal distances around each port opening 66.

Figure 8:
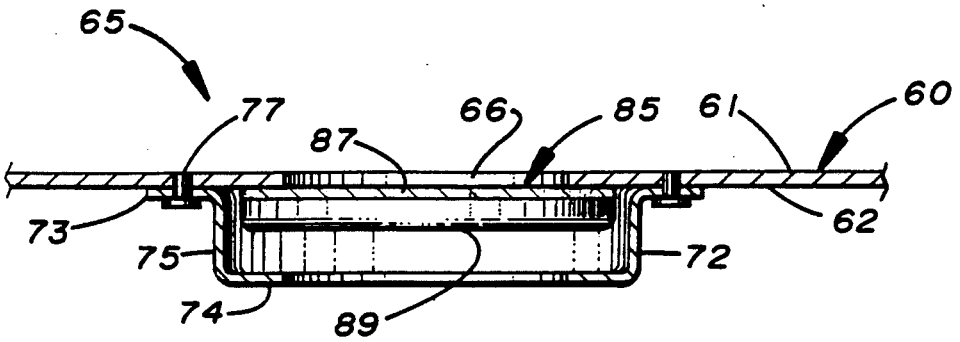
FIG. 8 is a sectional view taken along lines 8—8 in FIG. 7 showing a motion valve.

As more clearly shown in FIG. 8, each motion valve 65 comprises a port opening 66, a valve disk 85, and three restraining clips 72. Each port opening 66 is circular approximately 3 inches in diameter. Three clip openings 67 are manufactured around each port opening 66. Restraining clips 72 are attached to each clip opening by attachment means 77, such as a bolt or screw , to the bottom surface 62 of the stabilizing plate 60. Each restraining clip 72 is "S" shaped having an upper and lower horizontal flanges, 73 and 74, respectively, and a vertical flange 75. Each restraining clip 72 is oriented so that its lower horizontal flange 74 extends centrally towards its adjacent port opening 66.

During manufacture of the stabilization plate 60, a valve disk 85 is placed in each motion valve 65 between the three restraining clips 72. Each valve disk 85 has an upper section 87 made of lightweight, durable material, such as aluminum, which measures approximately 1/32 inch thick, and a loWer section 89 made of lightweight, highly buoyant material, such as foam polyethylene or foam polystyrene material, approximately ⅛ inch thick. The diameter of each valve disk 85 is slightly larger than the port openings 66, thereby enabling each valve disk 85 to completely cover the adjacent port opening 66 when pressed against bottom surface 62 of the stabilization plate 60. The overall thickness of each valve disk 85 is less than the space between the bottom surface 62 and lower horizontal flange 74 of restraining clip 72, thereby allowing the motion valve 65 to open and close.

Figure 9A:
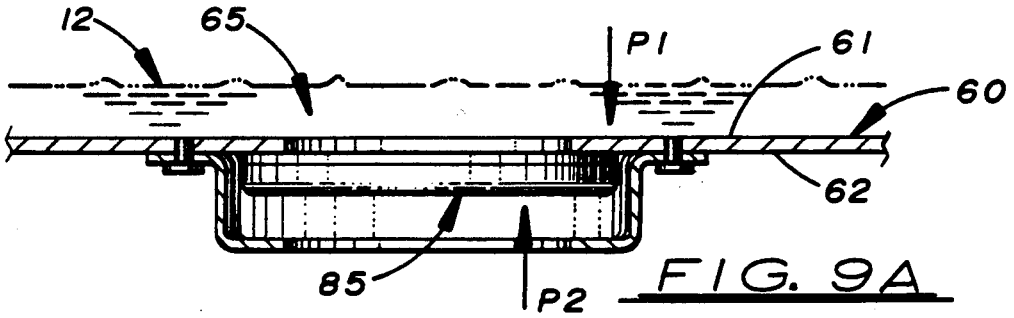
FIG. 9(*a*) is a sectional view similar to FIG. 8 illustrating the motion valve in a closed position.
Figure 9B:
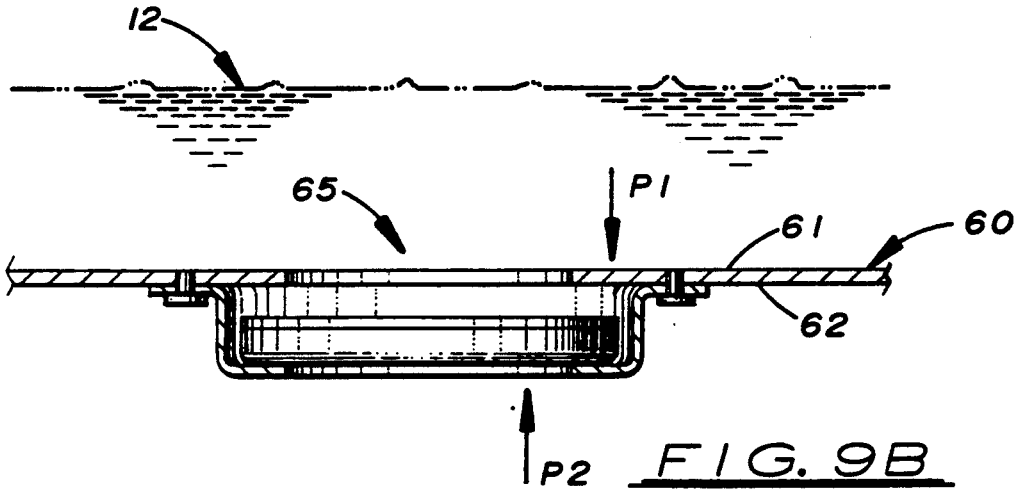

FIGS. 9(A) and (B), illustrate how water pressure variations on the top and bottom surface 61 and 62, respectively, of the stabilization plate 60 cause the motion valves 65 to open and close. As shown in FIG. 9(A), when the apparatus 10 is floating high relative to the surface of body of water Il, the amount of water on top surface 61 of stabilization plate 60 is relatively small. The downward pressure P1 exerted by this water is smaller than the upward pressure P2 exerted by the body of water 11 thereby causing valve disk 85 to move vertically and to press against the bottom surface 62 to close the port opening 66. This prevents water flow from beneath the stabilization plate through the port opening 66 and over the top surface 61 which would normal cause the oil layer 13 to flow away the apparatus 11. As shown in FIG. 9(B) wind or wave action may suddenly cause water to flow over the top surface 61 of the stabilization plate 60. This increases the pressure P1 exerted on top surface 61. When this pressure P1 exceeds the pressure P2 exerted on the bottom surface by the body of water, the valve disk 85 moves downward and opens the port opening 66. This allows the water on the top surface 61 to flow through the port opening 66 which, in turn, induces the flow of the oil layer 13 towards the air nozzle 26. In this manner, the flow of the oil layer 13 is induced toward the air nozzle 26 continuously during operation.

In addition to inducing the flow of the oil layer 13 towards air nozzle 26 using normal wave action, the opening and closing action of the motion valves 65 also provides apparatus 10 greater stability in the body of water 11 than conventional, non-stabilized floating structures.

Figure 10:
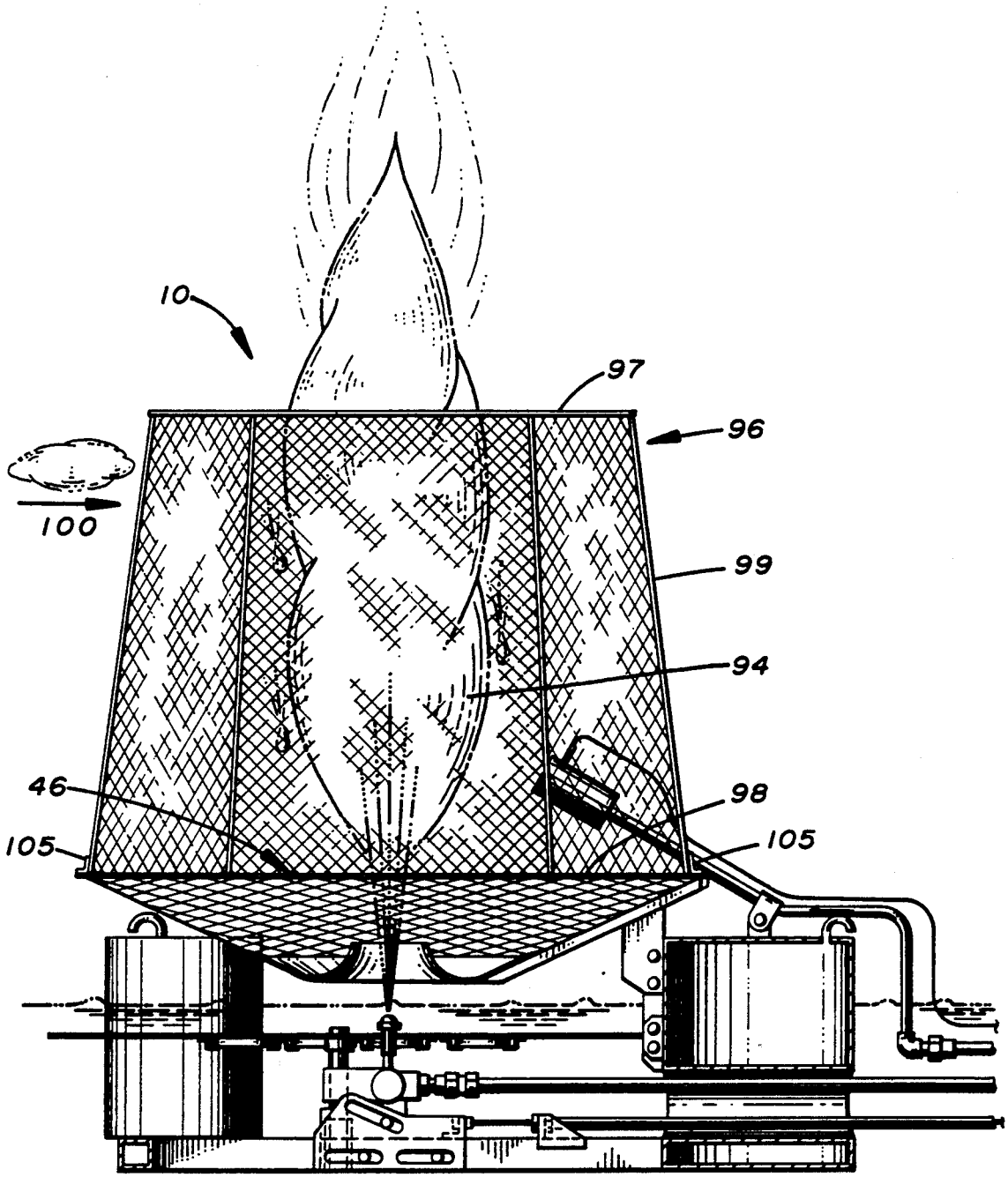
FIG. 10 is an sectional, elevational view of an optional screen stack attached to the upper surface of the drop-catching means.

As shown in FIG. 10, a screen stack 96 may be attached to the upper surface of the drop-catching means 45 to protect the combustion plume 94 from crosswinds 100. It has been shown, that cross winds 100 can chill the combustion plume 94 and substantially affect combustion of the oil. A screen stack 96, made of heat-resistant material that is impervious to wind, may be placed around the combustion plume 94 for protection. In the preferred embodiment shown, screen stack 96 has a vertical side 99 with a height sufficient to protect the combustion plume 94. Screen stack 96 has an upper stack opening 97 and a lower stack opening 98. A stack attachment means, such as a threaded bolt or screw 105, attaches the lower opening 98 to the upper edge 47 of drop-catching means 45.

In operation, apparatus 10 is first transported to the oil spill site. Apparatus 10 is relatively small compared to other oil burning devices and easily transported. The propane storage tank, ignition switch, and the adjustable compressed air source 27 are attached to the combustible fuel line 42, ignition source 40, and air nozzle bracket 48, respectively. Air nozzle adjustment cable 30 is attached to cross member 33 and cable support means 31. Using air nozzle adjustment cable 30, air nozzle 26 is then set in position so that its tip is approximately ⅛ inch beneath the surface of oil layer 13 when the apparatus 10 is floating.

Once the apparatus 10 is placed in the body of water 11, the propane gas 43 is turned on and ignited by the ignition source 40. The stream of compressed air 25, set initially at approximately 30 p.s.i., is then transmitted to the air nozzle bracket 29 The stream of compressed air 25 travels through the air nozzle bracket 29 and into the air nozzle 26 and then emitted vertically through the oil layer 13 located immediately above the air nozzle 26. As the compressed air 25 travels vertically through the oil layer 13, the oil layer 13 is atomized and lifted through the lower circular opening 51 and into the combustion region 55. The ignited combustible fuel 44 emitted from gas nozzle 41 causes the atomized oil droplets to ignite and burn creating a combustion plume 94. The heat generated during the combustion process produces low visibility combustion emissions 14.

It is apparent that the amount of oil layer 13 lifted and atomized upwardly into the combustion region 55 is limited by the area of the shear face between the oil layer 13 and the pressure of the compressed air 25. Therefore, the ability of apparatus 10 to lift and atomize the oil layer 13 is directly related to the thickness of the oil layer 13 located directly above the air nozzle 26 and the velocity of the stream of compressed air 25. Prior to operation, the position of the air nozzle 26 and the amount of compressed air 25 delivered by the air nozzle 26 are set by an operator. During operation, the operator monitors the wind, water conditions, and the thickness of the oil layer 13 and makes necessary adjusts of the vertical position of air nozzle 26 to keep apparatus 10 operating optimally.

During the combustion process, any ignited oil droplets 92 that escape from the combustion plume 94 are caught by drop-catching means 45 and thereby prevented from landing in the oil layer 13. The ignited oil droplets 92 upon striking the screen surface either break up, disburse, or adhere to surface. The impact on the screen causes any hot gases trapped inside the ignited oil droplets 92 disburse, thereby extinguishing any flames that may arise.

In compliance with the statute, the invention has been described in language more or less specific as to structural features. It should be understood, however, that the invention is not limited to the specific features shown since the means and construction shown comprise preferred forms of putting the invention into effect. The invention is, therefore, claimed in any of its forms or modifications within the legitimate and valid scope of the amended claims, appropriately interpreted in accordance with the doctrine of equivalents.

INDUSTRIAL APPLICABILITY

This invention will find wide use in the cleaning up of spills of a floating combustible material, such as oil, from a body of water. It may also find application in other industries where it is desirable to separate or remove a floating combustible material from another by using a jet air stream and combustion.

I claim:

1. A spray burn, floating combustible material burner apparatus for removing a floating layer of combustible material from the surface of a body of water, comprising:

a. a support frame;

b. a buoyancy system attached to said support frame which enables said apparatus to float in said body of water, said buoyancy system being attached to said support frame such that when said apparatus is placed in said body of water, said support frame is submerged therein;

c. an air nozzle attached to said apparatus such that said air nozzle is disposed beneath said floating layer of combustible material when said apparatus is placed in said body of water, said air nozzle being attached to an adjustable supply of compressed air capable of lifting and atomizing said floating layer of combustible material into a combustion region located above said apparatus;

d. an air nozzle adjustment means disposed between said support frame and said air nozzle, said air nozzle adjustment means being capable of vertically adjusting the position of said air nozzle with respect to the surface of said body of water;

e. a drop-catching means attached to said apparatus positioned above said air nozzle, said drop-catching means being capable of catching ignited combustible material droplets which might fall from said combustion region when said apparatus is operating, said drop-catching means having a lower section;

f. a deflection plate attached to said drop-catching means, said defection plate having a lower circular opening, said lower circular opening being located above said air nozzle so that said adjustable supply of compressed air may be transmitted through said deflection plate and into said combustion region, said lower circular opening being capable of inducing the air current between said deflection plate and the surface of said floating layer of combustible material towards said lower circular opening when said compressed air is transmitted through said lower circular opening, whereby said air current acts to induce the flow of said floating layer of combustible material towards said air nozzle during operation;

g. a stabilization plate attached to said apparatus, said stabilization plate being attached to said apparatus such that said stabilization plate is disposed along said surface of said body of water when said apparatus is placed thereon, said stabilization plate being capable of stabilizing said apparatus in said body of water and being capable of inducing the flow of said floating layer of combustible material towards said air nozzle using normal wave action, and;

h. an ignition source used to ignite the atomized said floating layer of combustible material.

2. An apparatus as recited in claim I, wherein said support frame comprises:

a. three leg members, said leg members being joined together to form a triangular-shaped structure, and;

b. a central frame member, said central frame member extending horizontally across said triangular-shaped structure from one corner to an opposite said leg member, said central frame member having two opposite vertical surfaces.

3. An apparatus as recited in claim 2, wherein said buoyancy system comprises three float structures, one said float structure being attached to one corner of said support frame.

4. An apparatus as recited in claim 3, wherein said air nozzle adjustment means comprises:

a. an air nozzle bracket attached to said air nozzle;

b. two adjustment plates interconnected at one end by a cross-member, said adjustment plates being slidably attached to said air nozzle bracket and slidably attached to said central frame member;

c. a guide pin disposed vertically between said central frame member and said stabilization plate, said guide pin being slidably attached to said air nozzle bracket and said stabilization plate and rigidly attached to said central frame member;

d. an air nozzle adjustment cable attached to said cross member;

e. whereby when said air nozzle adjustment cable is pulled or pushed, said adjustment plates move horizontally along said central frame member and forcibly move said air nozzle bracket vertical thereby adjusting the vertical position of said air nozzle.

5. An apparatus as recited in claim 4, wherein said adjustment plates and said air nozzle bracket are slidably attached to said air nozzle bracket by pin openings located on each said adjustment plate which engage laterally extending pins located on said air nozzle bracket.

6. An apparatus as recited in claim 5, wherein said adjustment plates and said central frame member are slidably attached to said central frame member by roller pin openings located on each adjustment plate which engage roller pins located on said central frame member.

7. An apparatus as recited in claim 2, wherein said drop-catching means comprises a conical structure with a circular upper edge and a lower surface.

8. An apparatus as recited in claim 7, wherein said drop-catching means is made of screen material.

9. An apparatus as recited in claim 8, wherein said screen material has screen openings approximately ½ inches (W)×¾ inches (H).

10. An apparatus as recited in claim 9, wherein said dropcatching means is made of solid plate material.

11. An apparatus as recited in claim 1, wherein said deflection plate is conical structure and cup-shape in cross-section, said lower circular opening having an upwardly extending top surface and a round bottom surface.

12. An apparatus as recited in claim 1, wherein said stabilization plate comprises:

a. flat circular structure, said stabilization plate having a top surface and a bottom surface, and;

b. a plurality of motion valves manufactured on said stabilization plate, said motion valves enabling said stabilization plate to respond upwardly and downward to normal wave action.

13. An apparatus as recited in claim 12, wherein each said motion valve comprises:

a. a port opening manufactured on said stabilization plate;

b open valve disk placed adjacent to each said port opening along said bottom surface of said stabilization plate, each said valve disk being slightly larger than said port opening.

c. a plurality of restraining clips positioned around each said port opening capable of keeping each said valve disk adjacent to each said port opening, each said restraining clips being attached along at one end to said bottom surface of said stabilization plate, each said restraining clip enabling each said valve disk to move vertically to open or close each said port opening in response to different water pressures located above and below said stabilization plate.

14. An apparatus as recited in claim 13, wherein said valve disk has an upper section made of aluminum and a lower section made of buoyant material.

15. An apparatus as recited in claim 14, wherein said buoyant material is made of foam polyethylene material.

16. An apparatus as recited in claim 14, wherein said buoyant material is made of foam polystyrene material.

17. An apparatus as recited in claim 12, wherein said stabilization plate is made of then aluminum plate material.

18. An apparatus as recited in claim 1, wherein said ignition source comprises:

a. a gas nozzle located above said deflection plate;

b. an ignition means located proximately to said gas nozzle, and;

c. a combustible fuel source attached to said gas nozzle capable of transporting a combustible fuel thereto.

19. An apparatus as recited in claim 18, wherein said ignition means is electrically activated.

20. An apparatus as recited in claim 1, further comprising a screen stack attached above said apparatus for protecting said apparatus from cross-winds. along said upper edge of said drop-catching means.

21. An apparatus as recited in claim 20, wherein said screen stack is attached along said upper edge of said drop-catching means.

22. An apparatus for burning a floating layer of combustible material on the surface of a body of water, comprising:

a. a support frame, said support frame including three leg members and a central frame member, said leg members being joined together. to form a triangular-shaped structure, said central frame member extending horizontally across said triangular-shaped structure from one corner to an opposite said leg member, said central frame member having two opposite vertical surfaces;

b. a buoyancy system attached to said support frame which enables said apparatus to float in said body of water, said buoyancy system being attached to said support frame such that when said apparatus is placed in said body of water, said support frame is submerged, said buoyancy system including three float structures, one said float structure being attached to each corner of said support frame;

c. an air nozzle attached to said apparatus such that said air nozzle is disposed beneath the surface of said body of water when said apparatus is placed in said body of water, said air nozzle being attached to an adjustable stream of compressed air capable of lifting and atomizing said floating layer of combustible material into a combustion region, said air nozzle being capable of vertically transmitting said stream of compressed air through the surface of said body of water;

d. an air nozzle adjustment means disposed between said support frame and said air nozzle, said air nozzle adjustment means being capable of vertically adjusting the position of said air nozzle with respect to the surface of the body of water, said air nozzle adjustment means including an air nozzle bracket, two adjustment plates, a guide pin, and an air nozzle adjustment cable, said air nozzle bracket being attached to said air nozzle, said adjustment plates being vertically attached to said air nozzle bracket and horizontally attached to said central frame member, said guide pin being disposed vertically between said central frame member and said stabilization plate and slidable connected to said air nozzle bracket, whereby when said air nozzle adjustment cable is pulled or pushed, said adjustment plates are moved horizontally and focibly moved the air nozzle bracket and the air nozzle vertically;

e. a drop-catching means attached to said apparatus and positioned above said air nozzle, said drop-catching means being a conical structure with a circular upper edge, said drop-catching means being capable of catching ignited combustible material droplets which might fall from said combustion region;

f. a deflection plate attached to said drop-catching means, said deflection plate being a conical structure with a lower circular opening through which said adjustable supply of compressed air may be transmitted through, said lower circular opening being capable of inducing the air current between said deflection plate and the surface of said floating layer of combustible material towards said lower circular opening, thereby inducing the flow of said floating layer of combustible material towards said air nozzle during operation of said apparatus;

g. a flat, circular stabilization plate attached to said apparatus, said stabilization plate having a plurality of motion valves manufactured thereon capable of stabilizing said apparatus in said body of water and inducing the flow of said floating layer of combustible material towards said air nozzle, and;

h. an ignition source used to ignite the atomized said floating layer of combustible material.

* * * * *